US006349721B1

(12) United States Patent
Grilliot et al.

(10) Patent No.: US 6,349,721 B1
(45) Date of Patent: Feb. 26, 2002

(54) PROTECTIVE COVER FOR AIR FILTER AND FOR CONDUIT CONNECTING AIR FILTER TO BREATHING MASK

(75) Inventors: William L. Grilliot; Mary I. Grilliot, both of Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 09/411,493

(22) Filed: Oct. 4, 1999

(51) Int. Cl.[7] ..... A62B 17/00

(52) U.S. Cl. ..... 128/201.29; 128/205.25; 128/205.27

(58) Field of Search ..... 128/201.29, 205.25, 128/205.27; 2/1, 455, 456, 457

(56) References Cited

U.S. PATENT DOCUMENTS

| | | | | | |
|---|---|---|---|---|---|
| 3,043,300 | A | * | 7/1962 | Flagg | 128/144 |
| 3,070,132 | A | | 12/1962 | Sheridan | |
| 3,529,594 | A | * | 9/1970 | Charnley | 128/139 |
| 4,090,509 | A | * | 5/1978 | Smith | 128/142.5 |
| 4,401,707 | A | * | 8/1983 | Bailey et al. | 428/166 |
| 4,452,279 | A | | 6/1984 | Atwell | |
| 4,500,593 | A | * | 2/1985 | Weber | 428/257 |
| 4,643,229 | A | | 2/1987 | Hickin | |
| 4,901,370 | A | * | 2/1990 | Suda | 2/2 |
| H805 | H | | 8/1990 | Schriver et al. | |
| 5,082,721 | A | * | 1/1992 | Smith, Jr. et al. | 428/252 |
| 5,119,808 | A | | 6/1992 | Marquardt et al. | |
| 5,188,267 | A | * | 2/1993 | Sargent et al. | 224/215 |
| 5,233,821 | A | * | 8/1993 | Weber, Jr. et al. | 57/224 |
| 5,236,769 | A | * | 8/1993 | Paire | 428/196 |
| 5,279,287 | A | * | 1/1994 | Wiseman, Sr. | 128/201.29 |
| H1361 | H | * | 10/1994 | Tardiff, Jr. et al. | 128/206.12 |
| 5,399,418 | A | * | 3/1995 | Hartmanns et al. | 428/218 |
| 5,421,326 | A | * | 6/1995 | Rankin et al. | 128/201.19 |
| 5,490,501 | A | * | 2/1996 | Crowley | 128/204.17 |
| 5,506,043 | A | * | 4/1996 | Lilani | 428/229 |
| 5,524,616 | A | * | 6/1996 | Smith et al. | 128/205.27 |
| 5,572,880 | A | * | 11/1996 | Frustaci et al. | 62/259.3 |
| 5,617,900 | A | | 4/1997 | Weil | |
| 5,625,899 | A | * | 5/1997 | Snedeker | 2/81 |
| 5,628,308 | A | * | 5/1997 | Harges, Jr. et al. | 128/206.21 |
| 5,640,718 | A | * | 6/1997 | Aldridge | 2/81 |
| 5,727,401 | A | * | 3/1998 | Statham | 66/176 |
| 5,935,882 | A | * | 8/1999 | Fujita et al. | 442/247 |
| 6,145,686 | A | * | 11/2000 | Stinson | 220/62.22 |
| 6,192,520 | B1 | * | 2/2001 | Underwood et al. | 2/93 |

* cited by examiner

*Primary Examiner*—John G. Weiss
*Assistant Examiner*—Mital Patel
(74) *Attorney, Agent, or Firm*—Rockey, Milnamow & Katz, Ltd.

(57) ABSTRACT

A breathing mask worn by a firefighter or by another wearer in a hazardous environment exposing the wearer potentially to heat and/or flame as well as to smoke and/or other chemical and/or biological agents is provided with an air filter, which is contained in a canister having an air inlet or air inlets and being connected to the breathing mask via a conduit, and with a protective cover for the conduit and for the canister. The protective cover comprises a fabric shell, which covers the conduit, essentially as far as the breathing mask, and which covers the canister, except that the fabric shell has an air inlet or air inlets communicating with the air inlet or air inlets of the canister. The fabric shell is made from a heat-resistant, flame-resistant fabric, preferably an aluminized fabric, such as an aluminized knit comprising approximately 33% polybenzimidazole fibers and approximately 67% polyparaphenylene terephthalamide fibers. A flame-resistant mesh, preferably made from polybenzimidazole fibers, is interposed between the air inlet or air inlets of the fabric shell and the air inlet or air inlets of the canister.

5 Claims, 2 Drawing Sheets

PROTECTIVE COVER FOR AIR FILTER AND FOR CONDUIT CONNECTING AIR FILTER TO BREATHING MASK

TECHNICAL FIELD OF THE INVENTION

This invention pertains to a protective cover for an air filter and for a conduit connecting the air filter to a breathing mask worn by a firefighter or by another wearer in a hazardous environment. The protective cover comprises a fabric shell made from a heat-resistant, flame-resistant fabric, such as an aluminized fabric.

BACKGROUND OF THE INVENTION

A breathing mask of a type known heretofore is provided with an air filter, which is contained in a canister having an air inlet or air inlets and being connected to the breathing mask via a conduit, such as a flexible, corrugated conduit. The air filter is designed to remove smoke and/or other chemical and/or biological agents. It is convenient herein to regard smoke as comprised of chemical agents. It is known for the breathing mask to be switchable by its wearer between an operating mode wherein the wearer breathes air delivered to the breathing mask by a self-contained breathing apparatus (SCBA) and an operating mode wherein the wearer breathes air delivered to the wearer through the air filter and the conduit.

Typically, as provided with a breathing mask of the type noted above, the air filter is made from a combustible material and the conduit is made from a material, such as a synthetic rubber applied over a fabric matrix, which is susceptible to combustion or to other heat or flame damage. So as to permit such a breathing mask provided with such an air filter and with such a conduit to be worn by a firefighter or by another wearer in a hazardous environment exposing the wearer potentially to heat and/or flame, such as heat and/or flame from aircraft engine or rocket exhausts, as well as potentially to smoke and/or other chemical and/or biological agents, as from a threat from terrorists, a need has been ascertained, to which this invention is addressed, for a way to protect the air filter and the conduit against heat and/or flame.

SUMMARY OF THE INVENTION

This invention provides for use with and combines with a breathing mask of the type noted above, a protective cover for the conduit and for the canister. The protective cover comprises a fabric shell, which is adapted to cover the conduit and to cover the canister, except that the fabric shell has an air inlet or air inlets adapted to communicate with the air inlet or air inlets of the canister. The fabric shell is made from a heat-resistant, flame-resistant fabric. Preferably, the fabric shell is made from an aluminized fabric, such as an aluminized knit comprising approximately 33% polybenzimidazole fibers and approximately 67% polyparaphenylene terephthalamide fibers.

Preferably, the protective cover comprises a flame-resistant mesh, which adapted to be interposed between the air inlet or air inlets of the fabric shell and the air inlet or air inlets of the canister. Preferably, moreover, the flame-resistant mesh is made from polybenzimidazole fibers.

These and other objects, features, and advantages of this invention are evident from the following description of a preferred embodiment of this invention, with reference to the accompanying drawings.

DETAILED DESCRIPTION OF THE PREFERRED EMBODIMENT

Figure 1:
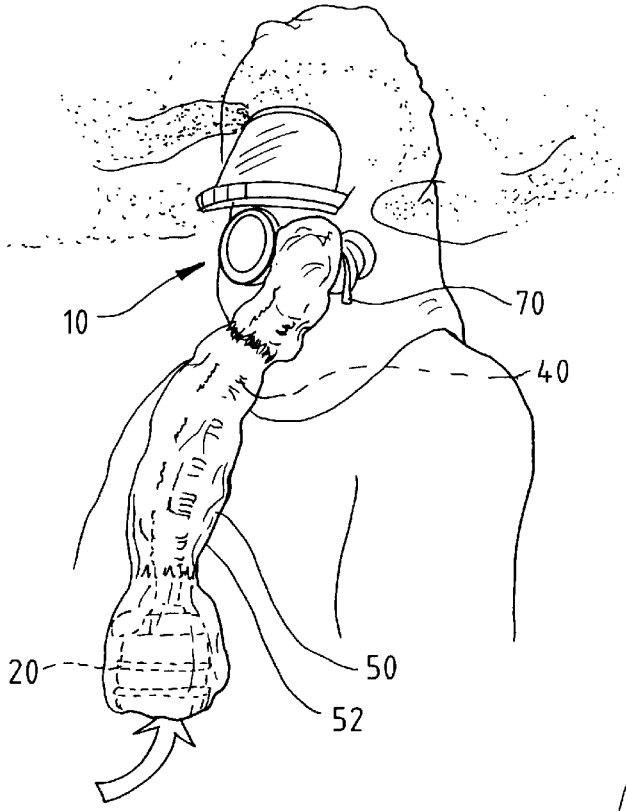
FIG. 1 is a fragmentary, perspective view of a breathing mask worn by a firefighter or by another wearer in a hazardous environment, a canister containing an air filter (see FIG. 2) having a plurality of air inlets, a conduit connecting the canister to the breathing mask, and a protective cover for the conduit and for the canister, as comprised in a preferred embodiment of this invention.
Figure 2:
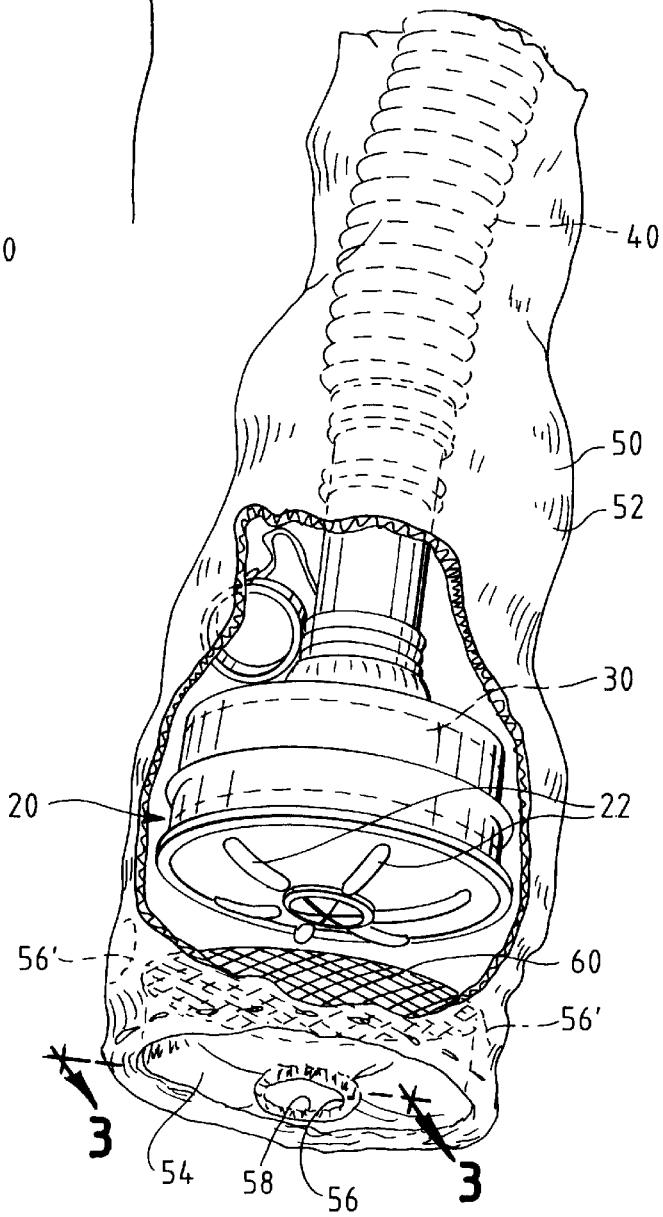
FIG. 2 is a greatly enlarged, partly exploded, partly broken away, fragmentary, perspective view of the canister containing the air filter, the conduit, and the protective cover, as shown in FIG. 1.
Figure 3:
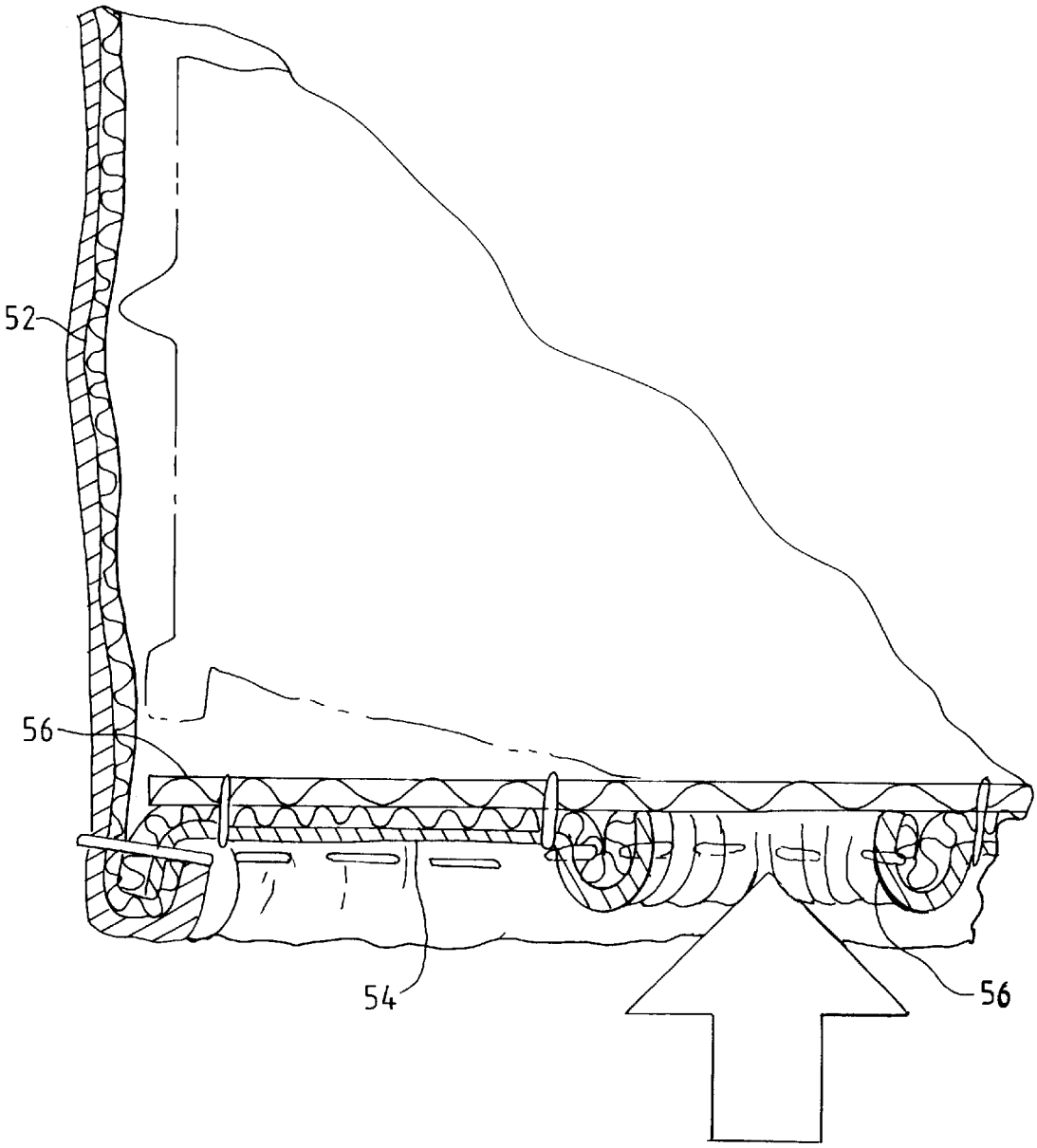
FIG. 3 is a further enlarged, fragmentary, sectional view of the protective cover, as taken along line 3—3 in FIG. 2, in a direction indicated by arrows.

As shown in FIGS. 1, 2, and 3, a preferred embodiment of this invention comprises a breathing mask 10, a canister 20 having a plurality of air inlets 22, an air filter 30 contained by the canister 20 and illustrated schematically in FIG. 2, in broken lines, a flexible, corrugated conduit 40 connecting the canister 20 containing the air filter 30 to the breathing mask 10, and a protective cover 50 for the conduit 40 and for the canister 20 containing the air filter 30. Rather than a plurality of air inlets 22, the canister 20 may have one air inlet, such as one of the air inlets 22, or one air inlet, not shown, which is located centrally.

The protective cover 50 comprises a fabric shell 52, which covers the conduit 40, essentially as far as the breathing mask 10 so as not to cover the breathing mask 10, and which covers the canister 20 containing the air filter 30, except that the fabric shell 52 has an end portion 54 including an air inlet 56 located centrally, as shown. The air inlet 56 communicates with the air inlets 22 of the canister 20 containing the air filter 30. The air inlet 56, which is circular, is reinforced at its margin 58 by stitching, as shown, or by a grommet, not shown. Rather than one air inlet 56, the fabric shell 52 may have a plurality of air inlets 56', as shown in broken lines in FIG. 2, which are located near but not at the end portion 54.

Although the canister 20 is made from metal, such as steel or aluminum, so as to be non-combustible as a practical matter, the air filter 30 is made from a combustible material, such as a cellulosic material impregnated with activated carbon and/or with other active agents, and the conduit 40 is made from a combustible material, such as a synthetic rubber applied over a fabric substrate. However, the fabric shell 52 of the protective cover 50 is made from a heat, resistant, flame-resistant fabric.

Preferably, the fabric shell 52 of the protective cover 50 is made from an aluminized fabric, such as an aluminized knit comprising approximately 33% polybenzimidazole fibers and approximately 67% polyparaphenylene terephthalamide fibers. Such an aluminized knit comprising approximately 33% polybenzimidazole fibers and approximately 67% KEVLAR™ polyparaphenylene terephthalamide fibers is available commercially from Gentex Corporation of Carbondale, Pa. PBI is a common abbreviation for polybenzimidazole. KEVLAR is a trademark of E.I. du Pont de Nemours and Company of Wilmington, Del., for polyparaphenylene terephthalamide. Heretofore, such an aluminized knit has been used commercially by Morning Pride Manufacturing, L.L.C. of Dayton, Ohio, and by its predecessor, Morning Pride Manufacturing, Inc., to make various garments for firefighters.

As shown in FIGS. 2 and 3, the protective cover 50 comprises a flame-resistant mesh 60, which is sewn into the fabric shell 52 so as to be interposed between the air inlet 52 of the fabric shell 54 and the air inlets 22 of the canister 20. The flame-resistant mesh 60 may be essentially circular, as shown, or may have a cylindrical portion, not shown, which wraps around the canister 20, as well as a circular portion, as shown. Preferably, moreover, the flame-resistant mesh 60 is made from polybenzimidazole fibers. Such a mesh is available commercially, in a knitted form, from SSM, Inc. of Spring City, Tenn., under a trade description of a "porthole knit" mesh. Heretofore, such a mesh made from such fibers has been used commercially by Morning Pride Manufacturing, L.L.C. of Dayton, Ohio, and by its predecessor, Morning Pride Manufacturing, Inc., to make components of various garments for firefighters.

As shown in FIG. 1, a draw tape, ribbon, or string 70 is used to tie the fabric shell 52 to the conduit 40, where the conduit 40 is attached to the breathing mask 10. An elastic member, not shown, may be alternatively used.

The protective cover 50 enables the breathing mask 10, the canister 20 containing the air filter 30, and the conduit 40 connecting the canister 20 containing the air filter 30 to the breathing mask 10 to be advantageously worn by a firefighter or by another wearer in a hazardous environment exposing the wearer potentially to heat and/or flame, such as an environment exposing the worker potentially to aircraft engine or rocket exhausts, as well as potentially to smoke and/or other chemical and/or biological agents, as from a threat from terrorists.

Various modifications may be made in the preferred embodiment shown and described herein without departing from the scope and spirit of this invention.

What is claimed is:

1. For use by a firefighter or by another wearer in a hazardous environment exposing the wearer potentially to heat, flame, or both as well as to smoke or other chemical or biological agents, a combination comprising a breathing mask, a canister containing an air filter and having an air inlet or air inlets, a conduit connecting the canister to the breathing mask, and a protective cover for the conduit and for the canister, the protective cover comprising a fabric shell, defining a sleeve which covers the conduit, essentially as far as the breathing mask, which does not cover the breathing mask, and which covers the canister, except that the fabric shell has an air inlet or air inlets communicating with the air inlet or air inlets of the canister, the conduit extending through the fabric shell, and the fabric shell being made from a heat-resistant, flame-resistant fabric.

2. The combination of claim 1 wherein the protective cover comprises a flame-resistant mesh, which is interposed between the air inlet or air inlets of the fabric shell and the air inlet or air inlets of the canister.

3. The combination of claim 1 wherein the fabric shell is made from an aluminized fabric.

4. The combination of claim 3 wherein the aluminized fabric is an aluminized knit comprising approximately 33% polybenzimidazole fibers and approximately 67% polyparaphenylene terephthalamide fibers.

5. The combination of claim 2 wherein the flame-resistant mesh is made from polybenzimidazole fibers.

* * * * *